US010125561B2

(12) United States Patent
Cramm et al.

(10) Patent No.: US 10,125,561 B2
(45) Date of Patent: Nov. 13, 2018

(54) METHOD FOR HYDRAULIC COMMUNICATION WITH TARGET WELL FROM RELIEF WELL

(71) Applicant: HALLIBURTON ENERGY SERVICES INC, Houston, TX (US)

(72) Inventors: Carl J. Cramm, Spring, TX (US); Joe E. Hess, Richmond, TX (US); Andy J. Cuthbert, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 206 days.

(21) Appl. No.: 14/899,064

(22) PCT Filed: Aug. 28, 2013

(86) PCT No.: PCT/US2013/057104

§ 371 (c)(1),
(2) Date: Dec. 16, 2015

(87) PCT Pub. No.: WO2015/030752

PCT Pub. Date: Mar. 5, 2015

(65) Prior Publication Data

US 2016/0123102 A1 May 5, 2016

(51) Int. Cl.
*E21B 29/00* (2006.01)
*E21B 7/04* (2006.01)
(Continued)

(52) U.S. Cl.
CPC ..... *E21B 29/002* (2013.01); *E21B 7/04* (2013.01); *E21B 7/06* (2013.01); *E21B 29/06* (2013.01);
(Continued)

(58) Field of Classification Search
CPC combination set(s) only.
See application file for complete search history.

(56) References Cited

U.S. PATENT DOCUMENTS 5,791,417 A * 8/1998 Haugen ..... E21B 7/061 166/117.6
6,065,209 A 5/2000 Gondouin
(Continued)

OTHER PUBLICATIONS

International Search Report and Written Opinion for PCT/US2013/057104 dated Mar. 25, 2014; 18 pages; United States Patent and Trademark Office, International Searching Authority.
(Continued)

*Primary Examiner* — Kyle Armstrong

(57) ABSTRACT

A system for establishing hydraulic communication between a relief well and a target well, wherein a relief well is drilled to include a portion of the target wellbore that is axially offset from and substantially parallel to a portion of the relief wellbore. Thereafter, a milling system is disposed in the relief well and utilized to mill a casing window that is facing the target well. The portion of the relief well is positioned so that fluid introduced into the relief well will flow through the formation to the target well. To enhance the flow, the formation and/or the casing of the target well may be perforated, milled or partially drilled. A latch coupling disposed in the relief well casing may be utilized to engage a latch on of the milling and or a perforating tool in order to ensure proper orientation relative to the target well.

29 Claims, 5 Drawing Sheets

(51) Int. Cl.

| | |
|---|---|
| ***E21B 29/06*** | (2006.01) |
| ***E21B 43/30*** | (2006.01) |
| ***E21B 7/06*** | (2006.01) |
| ***E21B 33/13*** | (2006.01) |
| ***E21B 43/11*** | (2006.01) |
| ***E21B 47/00*** | (2012.01) |

(52) U.S. Cl.
CPC ..... *E21B 33/13* (2013.01); *E21B 43/11* (2013.01); *E21B 43/30* (2013.01); *E21B 47/00* (2013.01)

(56) References Cited

U.S. PATENT DOCUMENTS

| | | | | |
|---|---|---|---|---|
| 6,761,217 | B1 | 7/2004 | McGarian | |
| 7,077,206 | B2 | 8/2006 | Kennedy et al. | |
| 7,878,270 | B2 | 2/2011 | Lee et al. | |
| 8,011,453 | B2 | 9/2011 | Lavrut et al. | |
| 8,453,737 | B2 | 6/2013 | McGlothen et al. | |
| 8,459,357 | B2 | 6/2013 | Dewey et al. | |
| 2005/0150692 | A1* | 7/2005 | Ballantyne | E21B 7/062 175/61 |
| 2005/0178551 | A1 | 8/2005 | Tolman et al. | |
| 2009/0266544 | A1* | 10/2009 | Redlinger | E21B 4/02 166/298 |
| 2014/0174740 | A1* | 6/2014 | Parlin | E21B 29/02 166/292 |
| 2015/0021029 | A1* | 1/2015 | Abrant | E21B 29/06 166/298 |

OTHER PUBLICATIONS

Kallhovd, A., "Evaluation of a Dual Relief Well Operation," Norwegian University of Science and Technology [Diploma Thesis], Jun. 2013, p. 21, Figure 2.6; p. 22, Paragraph 4; p. 23, Paragraph 1.

Kikuchi, S., et al., "Challenges, Lessons Learned, and Successful Implementations of Multilateral Completion Technology Offshore Abu Dhabi," Abu Dhabi International Petroleum Exhibition and Conference, pp. 181-190, Nov. 5-8, 2006, Abu Dhabi, UAE.

Peterson, E. M., et al., "How Much Is Left of Your Centralizer After Exiting a Casing Window in an Extended-Reach Horizontal Multilateral: Modeling, Yard Tests, and Field Results From Alaska's West Sak Development," Society of Petroleum Engineers Drilling/International Association of Drilling Contractors Drilling Conference, Feb. 20-22, 2007, Amsterdam, The Netherlands.

Ponton, C., et al., "Are You on the Right Track with Casing Milling? Innovative Precision-Milled Windows Offer Improved Casing Exit Reliability for Sidetracking and Multilateral Completions," International Association of Drilling Contractors/Society of Petroleum Engineers Drilling Conference and Exhibition, Feb. 2-4, 2010, New Orleans, Louisiana, USA.

* cited by examiner

METHOD FOR HYDRAULIC COMMUNICATION WITH TARGET WELL FROM RELIEF WELL

CROSS REFERENCE TO RELATED APPLICATIONS

The present application is a U.S. National Stage patent application of International Patent Application No. PCT/US2013/057104, filed on 28 Aug. 2013, the benefit of which is claimed and the disclosure of which is incorporated herein by reference in its entirety.

BACKGROUND

Technical Field

Embodiments disclosed herein relate to well kill operations in hydrocarbon exploration. In particular, embodiments disclosed herein relate to the development of hydraulic communication between a target and a relief well without the need to intersect the two wells.

Description of Related Art

In the field of hydrocarbon exploration and extraction, it is sometimes necessary to drill a relief well to provide a conduit for injecting a fluid, such as mud or cement, into a target well. Such procedures most often occur when the relief well is drilled to kill the target well.

A relief well is typically drilled as a straight hole down to a planned kickoff point, where it is turned toward the target well using conventional directional drilling technology. Drilling is thereafter continued until the relief well intersects the target well, thereby establishing hydraulic communication between the two wells.

Because of the difficulty in intersecting the relief well with the target well, the relief well may be drilled at an incident angle to the target well rather than simply intersecting the target well perpendicularly.

In any event, upon intersection, fluid from the relief well typically U-tubes into the target well. Pumps are used to keep the annulus of the relief well full, followed by pumping at the appropriate kill rates until the blowout is dead.

DETAILED DESCRIPTION

Figure 1:
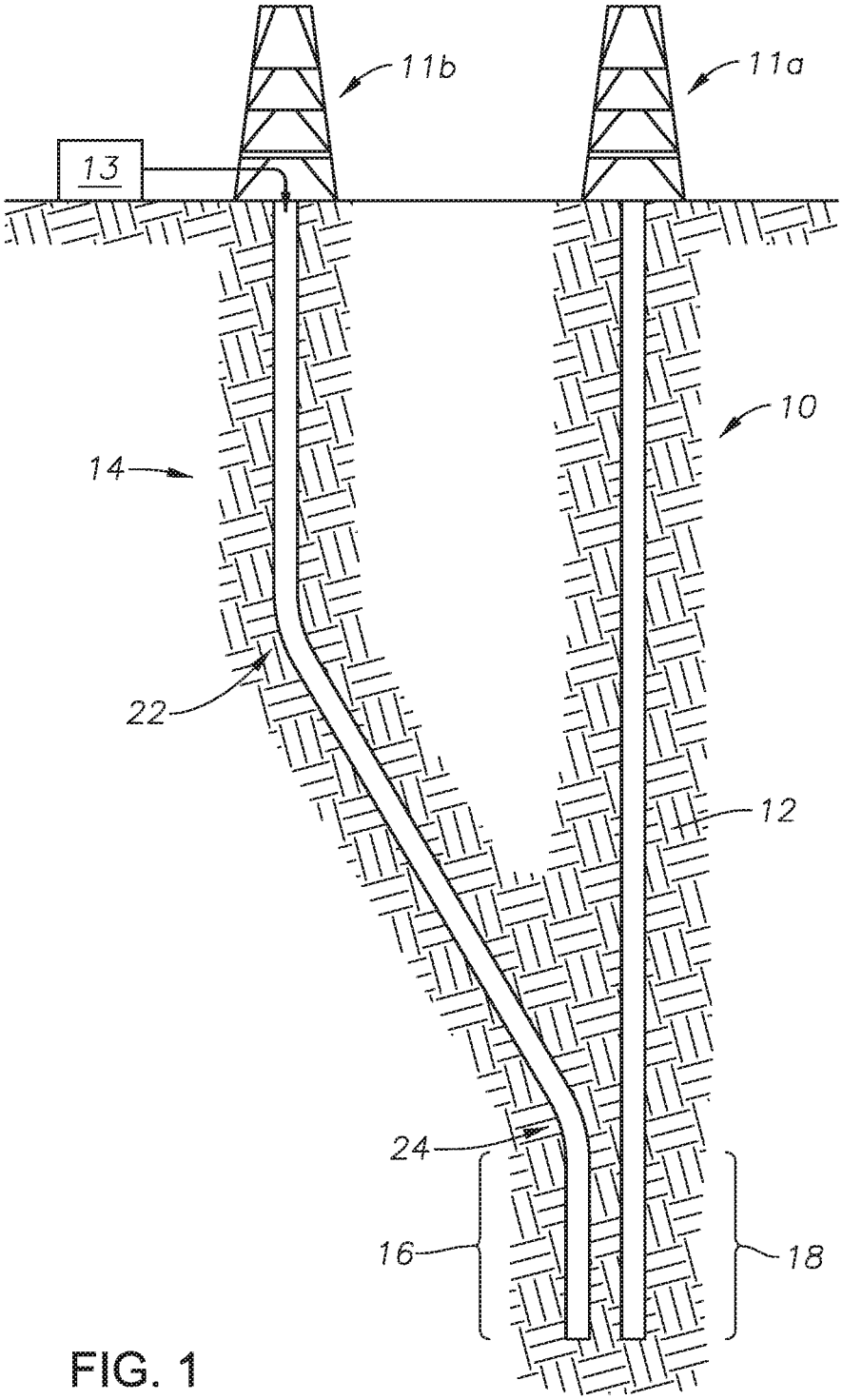
FIG. 1 shows the trajectory of a relief well relative to a target well according to some embodiments.

With reference to FIG. 1, a first or target wellbore 10 is shown in a formation 12. Although first wellbore 10 may have any orientation, for purposes of the discussion, first wellbore 10 is illustrated as extending substantially vertically from a drilling structure 11*a*.

A second or relief wellbore 14 is also shown in the formation 12 extending from a drilling structure 11*b*. Second wellbore 14 is drilled so that a portion 16 of second wellbore 14 is disposed adjacent a portion 18 of first wellbore 10. Drilling structures 11*a*, 11*b* are for illustrative purposes only and may be any type of drilling structure utilized to drill a wellbore, including land deployed drilling structures or marine deployed drilling structures. In this regard, the wellbores may extend from land or may be formed at the bottom of a body of water. Also illustrated is a fluid source 13 for the fluid to be introduced into second wellbore 14.

Preferably, portion 16 of second wellbore 14 is substantially parallel to portion 18 of first wellbore 10. The length of the respective parallel portions may be selected based on the amount of hydraulic communication necessary for a particular procedure. In certain embodiments, the length of the respective parallel portions may be approximately 10 to 40 meters, although other embodiments are not limited by such a distance.

It should be noted that first and second wellbores 10, 14 preferably do not intersect at the adjacent portions 16, 18, but are maintained in a spaced apart relationship from one another. In certain preferred embodiments, the spacing between the two wellbores at the adjacent portions is desirably between zero and 0.25 meters, although other embodiments are not limited by such a distance. It will be appreciated that the closer the second wellbore 14 is to the first wellbore 10, the more effective the method and system for establishing hydraulic communication therebetween.

Although the trajectory of second wellbore 14 need not follow any particular path so long as a portion 16 is positioned relative to a portion 18 of the first wellbore 10, as shown, relief wellbore 10 includes a first substantially vertical leg 20. Kickoff is initiated at point 22 in order to guide second wellbore 14 towards first wellbore 10. Any directional drilling and ranging techniques may be used at this point to guide second wellbore 14 towards first wellbore 10. Once second wellbore 14 has reached a desired offset distance, kickoff to tangent wellbore 10 is initiated at point 24 to form portion 16 of second wellbore 14.

As will be described below, hydraulic communication between second wellbore 14 and first wellbore 10 will be established at the respective adjacent portions 16, 18. First wellbore 10 may be cased or uncased at portion 18. To the extent portion 18 is cased, portion 18 is may be selected to have perforations 26 (shown in FIG. 2) to permit hydraulic flow from second wellbore 14 into first wellbore 10 through formation 12. Alternatively, when cased, portion 18 is selected as the target for either milled penetration and/or perforation as described below.

Figure 2:
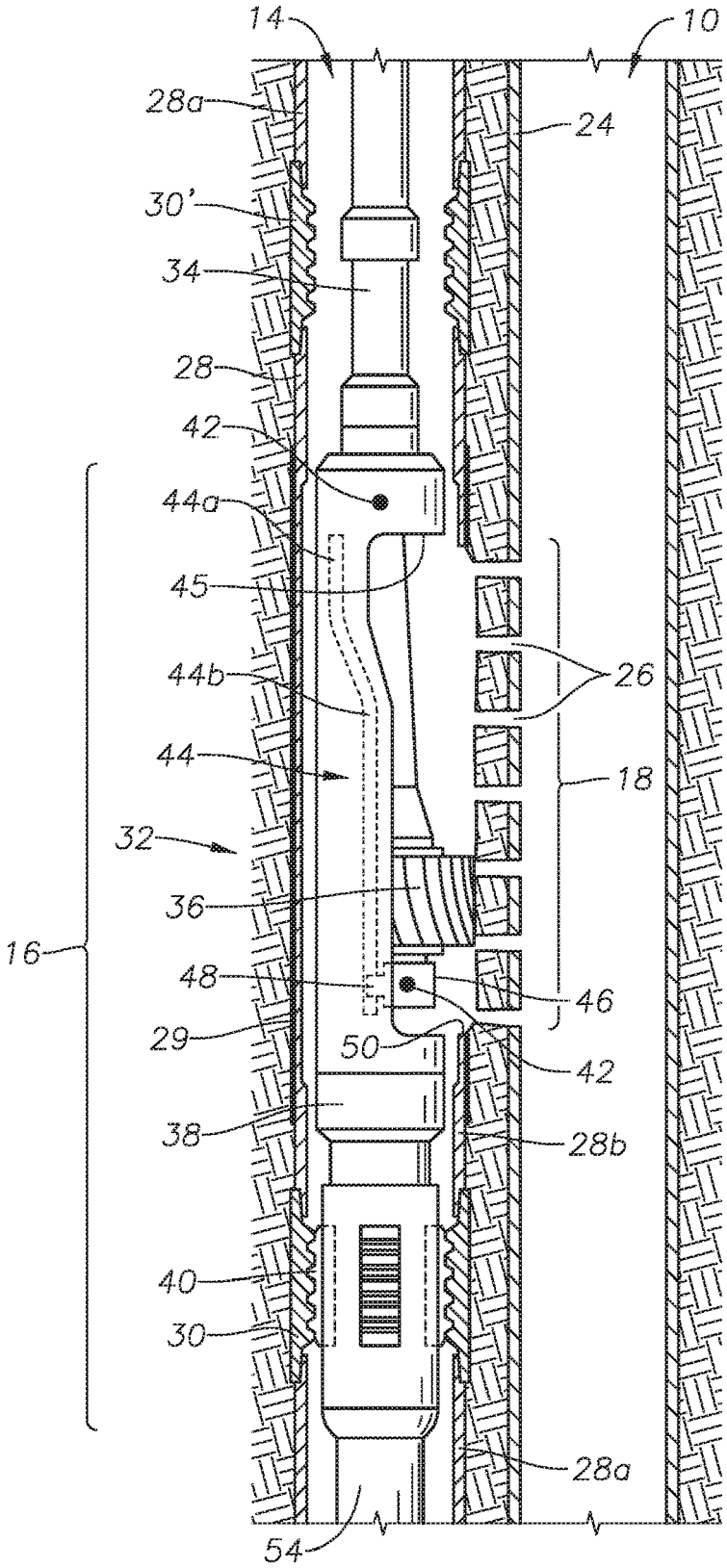
FIG. 2 illustrates a track guided milling system disposed in a relief well according to some embodiments.

Turning to FIG. 2, portion 16 of second wellbore 14 is illustrated adjacent portion 18 of first wellbore 10. In the illustration, first wellbore 10 includes casing 24. Casing 24 is illustrated with a plurality of perforations 26. Perforations 26 may existing perforations previously formed in wellbore 10 or alternatively, perforations 26 may be perforations formed from wellbore 14 using a perforation tool 52 as described herein (see FIG. 3).

Second wellbore 14 includes a casing 28 which preferably incorporates one or more keyed latch couplings 30 at known positions along at least a portion of the length of casing 28. In this regard, latch couplings 30 may be deployed at known spaced-apart intervals along the length of portion 16 of second wellbore 14. More specifically, each latch coupling 30 is carried on a latch coupling casing section 28*a*. Although not necessary, in certain embodiments, casing 28 may also include a window casing section 28*b*. Window casing section 28*b* may include a portion on the interior of casing section 28*b* with a diminished thickness (relative to the thickness of the overall casing joint) to enhance formation of a window during drilling. Alternatively, a window may be pre-milled in the casing section 28*b*. In other words, a portion of the window is "preformed" or "pre-milled" in casing section 28*b*. In this regard, at the point where the window is pre-formed or per-milled, window casing section 28*b* may include a support sleeve or cladding 29 disposed adjacent the area of the diminished thickness in order to provide structural support to casing section 28*b*. Sleeve 29 is preferably formed of a material that is easier to mill than the material forming the overall casing joint. For example, sleeve 29 may be formed of a non-ferrous material such as aluminum, fiberglass or similar material.

Disposed within second wellbore 14 is a guided milling system 32 carried on a pipe string 34. Guided milling system 32 includes a mill 36, a guide section 38, and a latch 40. In some embodiments, mill 36 is a milling blade, drill head or other cutting apparatus. Latch 40 is disposed to engage a keyed latch coupling 30 to axially and radially orient milling system 32 within casing 28 in order to establish hydraulic communications by methods described herein. Guided milling system 32 may further include an engagement mechanism 42 used to secure mill 36 to guide section 38 during run-in or deployment within second wellbore 14. In certain embodiments, engagement mechanism 42 may be one or more shear pins, hydraulically actuated locking dogs or the like.

The particular guided milling system 32 illustrated in FIG. 2 is a track-guided milling assembly that includes a constrained path 44, such as a track axially disposed along the guide section 38, a bearing 46 supporting milling blade 36, and a window 45 opposite track 44. Bearing 46 includes a follower 48 disposed to engage track 44 and move along track 44 under an axial force. Follower 48 may be any structure that engages track 44, such as a shoulder, tab, pin, flange or the like. As will be appreciated by persons of ordinary skill in the art, track 44 includes a section of track 44*a* that maintains milling blade 36 in a first position that is spaced apart from window 45 and transitions to a section of track 44*b* that moves milling blade 36 out radially to a second position in which milling blade 36 extends through window 45.

As milling blade 36 transitions to the second position, milling blade 36 engages casing 28. Thereafter, when milling blade 36 is in the second position, continued axial movement of milling blade 36 results in the milling of window 50 in casing 28, thereby exposing the interior of casing 28 to formation 12. It will be appreciated that because of the desirability to form window 50 in casing 28 so that the window is best oriented to face casing 24, a track-guided or similar precision milling assembly is preferred. Such a system will establish a known geometric window, prevent roll-off as may be experienced with other types of milling systems, and foreshorten a window aperture.

A perforation tool may be included on pipe string 34 above or below guided milling system 32, or may be separately conveyed into wellbore 14 once guided milling system 32 has been removed. For purposes of the description, a perforation tool 52 will be illustrated as carried on pipe string 34 below guided milling system 32. However, the disclosure is not limited to this particular configuration. Moreover, it should be understood that perforating tool 52 is not necessary for all embodiments, but may be utilized to enhance fluid flow through the formation 12 between first wellbore 10 and second wellbore 14 in some cases.

Figure 3:
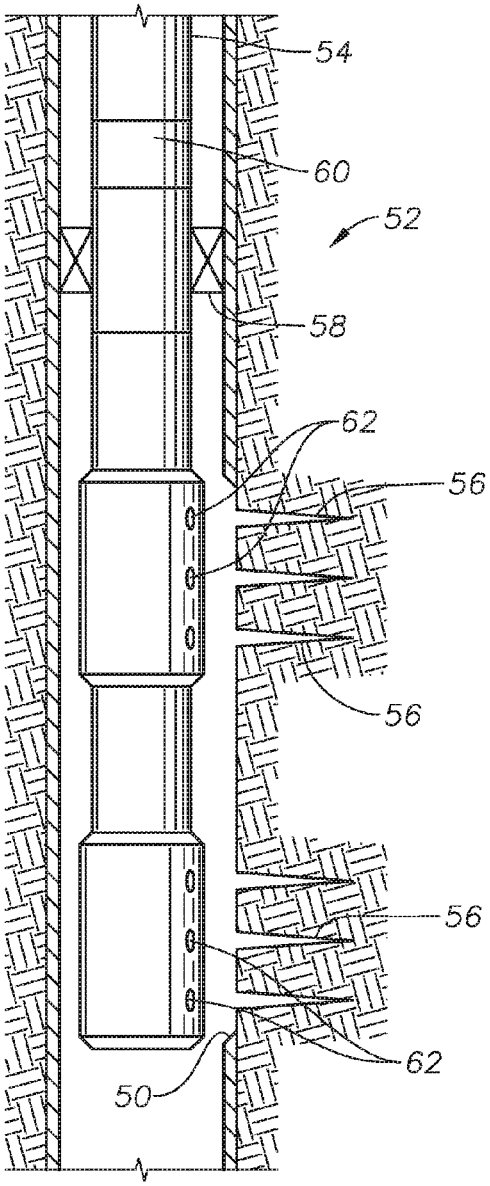
FIG. 3 illustrates an perforation tool that may be utilized in certain embodiments.

Thus, in FIG. 3, perforation tool 52 is illustrated. Perforation tool 52 is carried on pipe string 54 extending below milling system 32. Once window 50 has been milled, perforating tool 52 is positioned adjacent window 50 in order to form perforations outward into formation 12 towards first wellbore 10.

Preferably, the perforating tool 52 is positioned, sealed and secured in the casing 28 by a packer 58. The packer 58 seals off an annulus formed radially between the tubular string 52 and the wellbore 14. A firing head 60 is used to initiate firing or detonation of charges 62 of perforating tool 52 (e.g., in response to a mechanical, hydraulic, electrical, optical or other type of signal, passage of time, etc.), when it is desired to form the perforations 56. Although the firing head 60 is depicted in FIG. 3 as being connected above the perforating tool 52, one or more firing heads may be interconnected in the perforating tool 52 at any location, with the location(s) preferably being connected to the perforating tool by a detonation train.

In any event, it will be appreciated that perforating tool 52 is disposed to discharge or ignite charges 62 arranged only along a select portion of the radius of tool 52 so that the charges 62 form perforations 56 only through window 50. Moreover, due to the close proximity of wellbore 14 to wellbore 10, perforating tool 52 can also form perforations 26 (see FIG. 2) in casing 24 of first wellbore 10. In this regard, latch couplings 30 may be used to ensure the correct positioning of perforating tool 52. As a non-limiting example, milling system 32 may be withdrawn from the portion 16 until the latch 40 of milling system 32 engages an upper latch coupling, such as is illustrated at 30'. When so latched, then perforating tool 52 will be in position for actuation in order to form perforations 56 and/or perforations 26.

Figure 4:
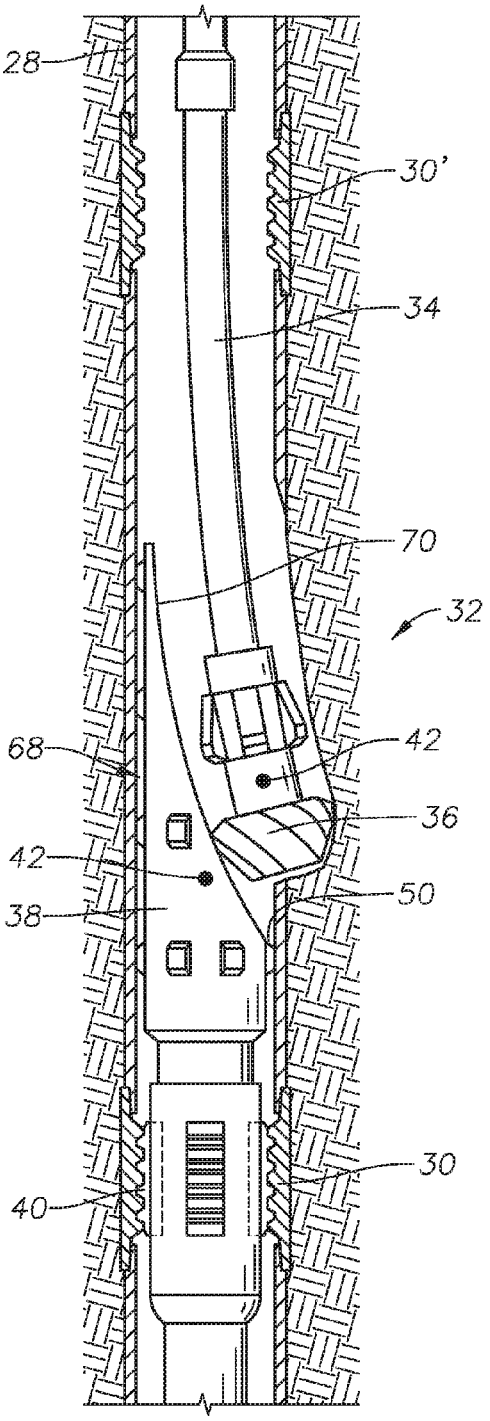
FIG. 4 illustrates a whipstock guided milling system disposed in a relief well according to some embodiments.

Turning to FIG. 4, another embodiment of a milling system 32 is illustrated. In this embodiment, guided milling system 32 carried on a pipe string 34. Guided milling system 32 generally includes a mill 36, a guide section 38, and a latch 40. Guided milling system 32 may further include an engagement mechanism 42 used to secure mill 36 to guide section 38 during run-in or deployment within second wellbore 14. In certain embodiments, engagement mechanism 42 may be one or more shear pins, hydraulically actuated locking dogs or the like.

The particular guided milling system 32 illustrated in FIG. 4 is a whipstock-guided milling assembly that includes a whipstock 68 of the type well known to persons of ordinary skill in the art. Whipstock 68 includes a deflection surface 70 that maintains milling blade 36 in a first position during run-in and that urges milling blade 36 out radially to a second position in which milling blade 36 engages casing 28 in order to mill window 50.

Figure 5:
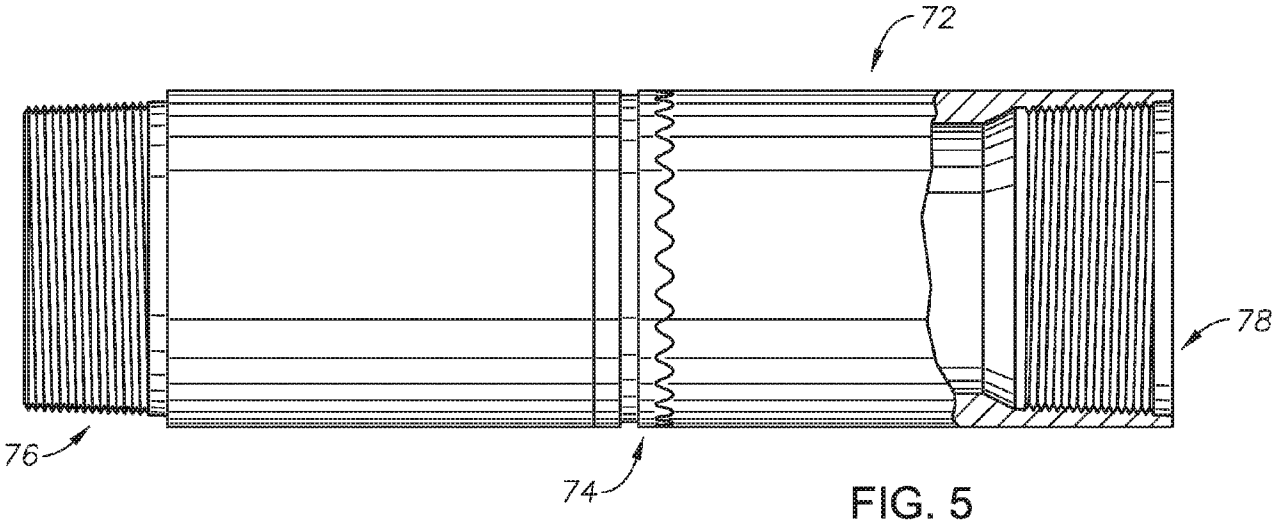
FIG. 5 illustrates an alignment sub used to align two adjacent casing components for a preferred orientation for the guided milling system deployed in a relief well.

With reference to FIG. 5, the system as described above may also include an alignment or timing sub 72 disposed in casing 28 of second wellbore 14. It will be appreciated that when casing 28 with latch coupling(s) 30 is deployed in second wellbore 14, it is desirable to ensure that the latch coupling 30 is properly positioned relative to a window casing section 28*b* so that the preformed window of window casing section 28*b* can be properly oriented for the operations described herein. Typically, due to the vagaries of making up adjacent sections of casing, the latch coupling casing 28*a* may not be aligned as desired with the window casing section 28*b*. Because precise placement of guided milling system 32 is desirable in order to achieve a window 50 that will yield the best results for the process described herein, alignment sub 72 may be used to compensate for differences in orientation between the latch coupling casing 28*a* and the window casing 28*b*, thereby assuring that system 32 is in the desired orientation upon engagement of latch 40 with latch coupling 30. Alignment sub 72 consists of an adjustment ring 74 disposed between a first threaded end 76 and a second threaded end 78. The alignment sub 72 is disposed in the casing string between the latch coupling casing 28*a* and the window casing 28*b*. The adjustment ring 74 allows the latch coupling casing 28*a* to be radially adjusted or aligned, preferably in one degree increments, relative to the window casing 28*b*.

Figure 6:
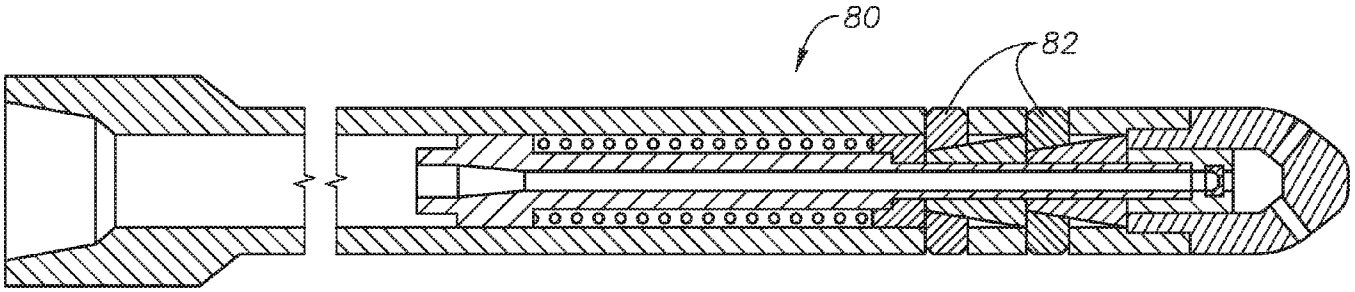
FIG. 6 illustrates a hydraulic locking tool.

FIG. 6 illustrates a hydraulic locking tool 80 that may be included in the above-described system in order to deploy a guide section 38 of guided milling system 32. In certain embodiments, hydraulic locking tool 80 consists of hydraulic pistons 82 which can be radially deployed during run-in or retrieval. Hydraulic locking tool 80 extends partially into the annulus of a guide section 38 and hydraulic pistons 82 are expanded radially outward to engage guide section 38. If the hydraulic locking tool 80 is utilized during run-in, it will be appreciated that in such case, mill 36 is not secured to guide section 38, but run-in separately. In any event, once the guide section 38 is set by engaging latch 40 with latch coupling 30, flow across hydraulic locking tool 80 allows the pistons 82 to retract and hydraulic locking tool 80 to be withdrawn so that the milling operation can proceed.

It will be appreciated that the latch coupling 30 and latch 40 assembly descried herein eliminates the need for a conventional milling anchor device and maintains full bore access to the lower main bore.

Figure 7:
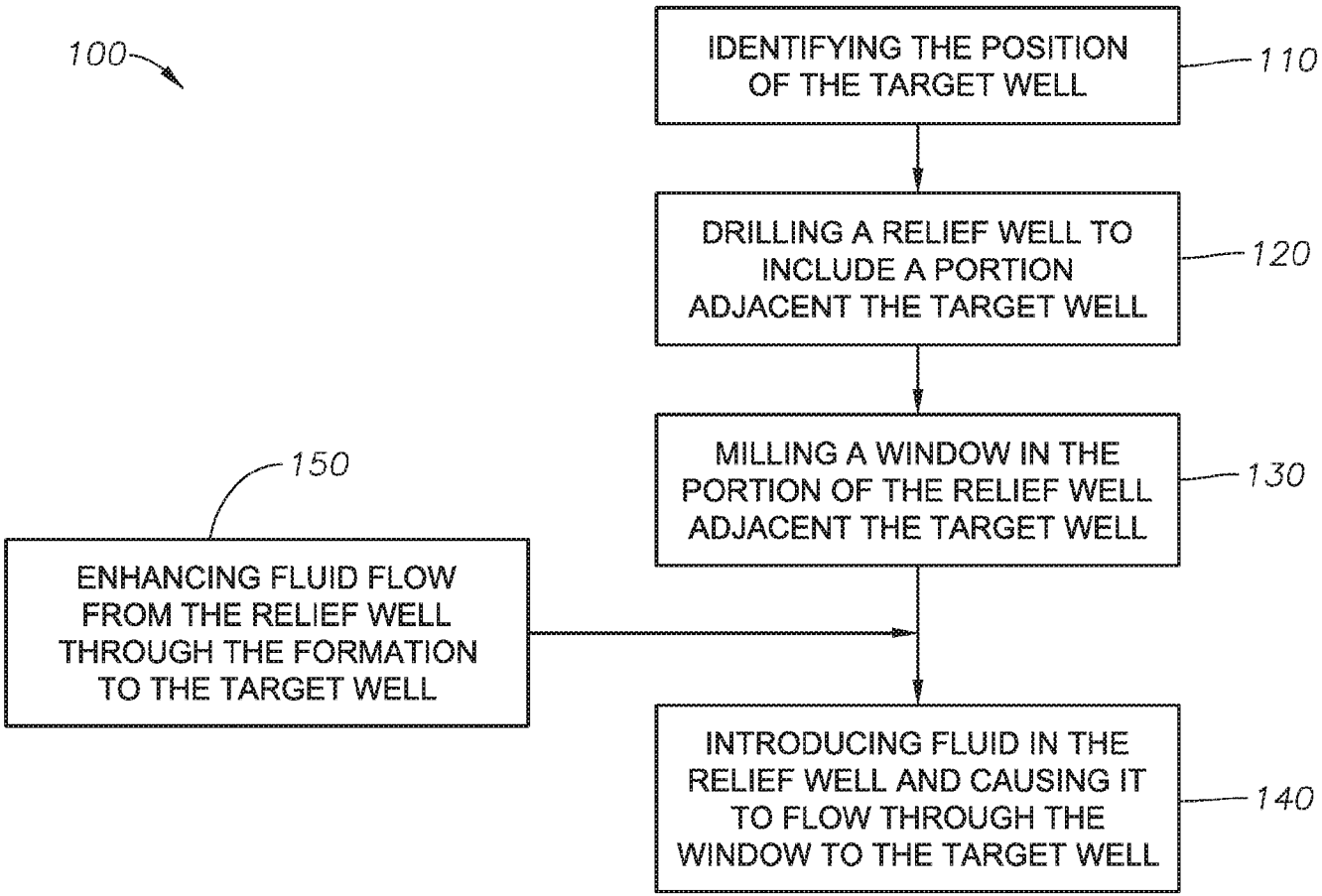
FIG. 7 shows a flow chart of one method for drilling a relief well and establishing hydraulic communication with a target well according to some embodiments.

FIG. 7 illustrates the steps of a method 100 to establishing fluid communication between a first well and a second well as described above. In a first step 110, the position of the first or target well is identified or otherwise determined Generally the trajectory of the first well will be known or mapped, allowing a second or relief well to be properly drilled and oriented relative to the first well. Thus, in step 120, a second well is drilled in the formation so that at least a portion of the length of the second well is adjacent a portion of the length of the first well. The portion of the length of the second well is drilled to be axially offset from and preferably parallel to the selected portion of the first well. The first well may be cased or uncased. In the event it is cased, it is preferable to select a portion of the first wellbore that has previously been perforated during operations related to the first wellbore. Alternatively, the section of the first well selected to establish hydraulic flow may be selected based on the ease by which the section may be readily perforated, milled or drilled from the second wellbore.

In step 130, a window is milled in the casing of the second well at the portion of the second well adjacent the selected portion of the first well. The window is milled so as to be facing the first well. To accomplish this step, a guided milling system is deployed in the second well. The guided milling system is preferably oriented by engaging a latch of the guided milling system with a latch coupling carried by the casing of the second well. Thus, during drilling and casing of the second well, the casing may include one or more latch couplings disposed along or adjacent to the relevant portion of the second well. Additionally, the deployed casing may include an aluminum sheath or portion at the area to be milled.

In certain embodiments, the milling system may be a track guided milling system, so that the method includes guiding the mill along a track or constrained path in order to more precisely form the window. In such system, the mill, such as a blade, is often supported by a bearing that moves along the track. In other embodiments, rather than a guide section having a track or constrained path, a whipstock may be deployed to guide the mill into contact with the casing of the second well.

Typically, during run-in, a release mechanism may be used to lock the guide of the guided milling system to the mill. Once in position, the release mechanism can be actuated, sheared or ruptured, as the case may be, to disengage the guide from the mill so that milling can proceed.

In step 140, a fluid is introduced into the second well and pumped or otherwise driven through the milled window, through the formation between the first and second wells and into the first well. Typically, such a procedure may be used to control pressure within the first well, such as when it is desired to kill the first well. Thus, the fluid is typically pumped under pressure. The fluid may be a drilling mud, cement or other gas, foam or fluid weighted material.

An additional step 150 may be performed after the window is milled in order to promote or enhance fluid flow from the second well through the formation to the first well. In step 150, the formation may be perforated by discharging a perforating tool through the window. To the extent the casing of the target wellbore is not perforated, in addition to perforating the formation, the discharged perforating tool may be used to also perforate the casing of the target wellbore. In other words, the casing of the target wellbore is perforated externally.

In addition to perforating the casing of the target wellbore, or alternatively thereto, in step 150, the casing of the target wellbore may be milled or drilled using a mill as described herein. It will be appreciated that any of the perforating, milling or drilling of the target casing from the second wellbore is enhanced by ensuring that the second wellbore is in close proximity and axially parallel with the first wellbore. As with the milling of the window itself, proper orientation of the perforating tool, and hence the charges thereon, is desirable so that the discharge is limited to discharge in the radial direction of the milled window. Therefore, the latch coupling may be used to engage a latch on the perforating tool. Alternatively, the latch carried by the guided milling system can be engaged with a second latch (such as 30' in FIG. 2) disposed in the casing string upstream or above the point where the window has been milled. Additionally or alternatively, to any of the enhancement operations described above, a second pass mill may be utilized to excavate or drill the formation adjacent the window between the first and second wells.

Because of the need for precision in performing the steps recited above, the latch and latch coupling as utilized are important in certain embodiments of the invention. A latch may be included on any of the components of the system as described herein, such as the guide or the perforating tool. To further ensure proper axial positioning and radial orientation of the milling system in the second wellbore, a hydraulic locking tool may be utilized to transport and deploy a guide section in the second wellbore. The hydraulic locking system extends at least partially into the guide section and secures thereto. The hydraulic locking system includes pistons or other engagement mechanism for coupling the hydraulic locking system to the guide section for deployment and/or retrieval. Once the latch of the guide section engages the latch coupling, the hydraulic locking tool is disengaged from the guide section so that milling operations can proceed.

To further ensure proper radial orientation of the milling system in the second wellbore, an alignment sub may be deployed in the second wellbore casing between a latch coupling casing and the window casing. The alignment sub permits the window casing to be axially rotated relative to the latch coupling casing in order to adjust for misalignment between the two. Thus, an actual make-up position of the latch coupling casing is determined relative to the window casing. An adjustment ring on the alignment sub may then be utilized to compensate for the difference between the actual and desired positions of the two casing sections so that when the latch of the guided milling system and/or the latch of the perforating tool engages the latch coupling, the guided milling system and/or perforating tool, as the case may be, is properly oriented for the hydraulic communication procedures described herein.

Moreover, while it is desirable to mill a suitable window 50 with only a first pass of a milling system as described herein, it will be appreciated that multiple passes may be necessary to sufficiently enlarge window 50 or excavate formation 12 in order to establish a desired level of hydraulic communication between first wellbore 10 and second wellbore 14. Thus, for example, the milling system illustrated in FIG. 2 may be utilized to form window 50 in casing 28, after which, the milling system illustrated in FIG. 4 may be utilized to widen window 50 or drill out some of the formation between first wellbore 10 and second wellbore 14.

The invention claimed is:

1. A method of establishing fluid communication between a first well and a second well, the method comprising:
- identifying a position of a first well in a formation;
- drilling a second well in the formation so that at least a portion of a length of the second well is adjacent a portion of a length of the first well;
- positioning a track-guided milling system adjacent the casing;
- milling a window in a casing of the second well at the portion of the second well adjacent the first well, the milling further comprising:
  - supporting a milling blade with a bearing;
  - fixing the bearing to a track, thereby coupling the milling blade to the track; and
  - moving the bearing along the track, thereby guiding the milling blade along the track in order to mill the window; and
- introducing a fluid into the second well and driving the fluid through the window of the second well, through the formation between the first and second wells and into the first well.

2. The method of claim 1, wherein the milling comprises:
- positioning a track-guided milling system adjacent the casing to be milled; and
- utilizing the track-guided milling system to guide the milling blade into contact with the casing in order to mill the window.

3. The method of claim 2, further comprising:
- securing the milling blade within the track-guided milling system with a release mechanism;
- running the milling blade and the track-guided milling system into the second well;
- engaging a latch coupling in order to axially and radially orient the track-guided milling system at a predetermined location and a desired orientation in the second well; and
- releasing the milling tool from the track-guided milling system.

4. The method of claim 3, further comprising:
- after milling the window, releasing the track-guided milling system from the latch coupling;
- moving the track-guided milling system away from the window;
- engaging the latch coupling with a perforating gun, thereby axially and radially orienting the perforating gun at the predetermined location and the desired orientation in the second well; and
- perforating the first well through the window of the second well.

5. The method of claim 1, further comprising:
- deploying a window casing section in the second well at the portion of the second well that is adjacent the first well; and
- milling the window in the window casing section.

6. The method of claim 1, further comprising:
- perforating the formation between the window and the first well, wherein perforating includes:
  - once the window has been milled, positioning a perforating tool in the second well adjacent the window; and
  - actuating the perforating tool to perforate the formation.

7. The method of claim 6, wherein the perforating includes perforating a casing of the first well.

8. The method of claim 6, wherein a discharge of the perforating tool is limited to discharge in a radial direction of the first well.

9. The method of claim 1, wherein the fluid is pumped into the second well under pressure.

10. The method of claim 9, wherein the fluid is cement and/or weighted fluid.

11. The method of claim 1, further comprising:
- killing the first well by pumping the fluid into the second well and through the window of the second well.

12. The method of claim 1, further comprising:
- deploying a casing string in the second well, wherein deploying comprises positioning at least one latch coupling in the casing string.

13. The method of claim 12, wherein said milling comprises:
- engaging the latch coupling with a latch of a milling tool in order to position a milling tool adjacent the casing.

14. The method of claim 13, wherein said engaging axially and radially positions the milling tool.

15. The method of claim 1, further comprising:
- engaging a first latch coupling with a latch of a milling tool;
- milling the window;
- withdrawing the milling tool from adjacent the window;
- engaging a second latch coupling with the latch of the milling tool so as to position a perforating tool adjacent the milled window; and
- discharging the perforating tool through the milled window to form perforations in the casing of the first well.

16. The method of claim 1, further comprising:
- positioning an alignment sub in the casing string of the second well between a window casing portion and a latch coupling casing portion; and
- utilizing the alignment sub to adjust relative axial positions of the window casing portion and the latch coupling casing portion of the casing string.

17. The method of claim 1, further comprising:
- identifying a location along the length of the first well for establishing hydraulic communication; and
- drilling the second well so that the portion of the second well is adjacent the identified location.

18. The method of claim 1, wherein the portion of the second well is drilled to be axially offset from and substantially parallel to the portion of the first well.

19. A drilling system comprising:

a first well;

a second well adjacent the first well along a portion of a length of the second well, the second well having casing disposed along said portion; and a guided milling tool disposed in the second well adjacent the casing, the guided milling tool comprising a guide and a milling blade, wherein the guide is oriented to cause the milling blade to engage the casing of the second well at the portion of the length of the second well adjacent the first well, wherein a track is axially disposed along a length of the second well and the guided milling tool comprises a follower that engages the track and guides the guided milling tool along the track to mill the casing of the second well.

20. The drilling system of claim 19, wherein the guided milling tool is a track guided milling tool that comprises a milling blade and the milling blade is radially oriented in the second well so that the milling blade extends radially towards the first well.

21. The drilling system of claim 19, further comprising an elongated window formed in the casing, the elongated window radially disposed in the casing to face the first well.

22. The drilling system of claim 19, further comprising a perforating tool.

23. The drilling system of claim 19, further comprising a pipe string disposed in the second well and on which the guided milling tool is carried.

24. The drilling system of claim 19, further comprising a pipe string disposed in the second well and on which a perforating tool is carried.

25. The drilling system of claim 19, wherein the casing of the second well comprises a latch coupling and the guided milling tool comprises a latch for engagement with the latch coupling.

26. The drilling system of claim 19, further comprising an alignment sub carried by a pipe string, the alignment sub securing the guided milling tool to the pipe string.

27. The drilling system of claim 19, further comprising a hydraulic locking tool disposed around a portion of the guided milling tool.

28. The drilling system of claim 19, further comprising a latch coupling disposed along the casing, a pre-formed window disposed in the casing along the casing and an alignment sub carried by the casing between the latch coupling and the pre-formed window.

29. The drilling system of claim 28, further comprising a perforating tool carried by a pipe string.

* * * * *